US007010135B2

(12) United States Patent
Von Buol

(10) Patent No.: US 7,010,135 B2
(45) Date of Patent: Mar. 7, 2006

(54) METHOD TO DETERMINE A FEEDBACK THRESHOLD IN A HEARING DEVICE

(75) Inventor: Andreas Von Buol, Zürich (CH)

(73) Assignee: Phonak AG, Stafa (CH)

( * ) Notice: Subject to any disclaimer, the term of this patent is extended or adjusted under 35 U.S.C. 154(b) by 172 days.

(21) Appl. No.: 10/263,126

(22) Filed: Oct. 2, 2002

(65) Prior Publication Data

US 2004/0066946 A1 Apr. 8, 2004

(51) Int. Cl.
*H04R 25/00* (2006.01)

(52) U.S. Cl. ..... 381/318; 381/321

(58) Field of Classification Search ..... 381/56, 381/58, 60, 96, 107, 108, 312, 314, 318, 381/320, 321, 23.1
See application file for complete search history.

(56) References Cited

U.S. PATENT DOCUMENTS

| | | | | |
|---|---|---|---|---|
| 5,991,417 | A * | 11/1999 | Topholm | 381/60 |
| 6,128,392 | A | 10/2000 | Leysieffer et al. | 381/318 |
| 6,134,329 | A | 10/2000 | Gao et al. | 381/60 |
| 6,404,895 | B1 | 6/2002 | Weidner | 381/318 |
| 2001/0002930 | A1 * | 6/2001 | Kates | 381/317 |
| 2003/0012391 | A1 * | 1/2003 | Armstrong et al. | 381/312 |

FOREIGN PATENT DOCUMENTS

WO 00/21332 4/2000

* cited by examiner

*Primary Examiner*—Sinh Tran
*Assistant Examiner*—Brian Ensey
(74) *Attorney, Agent, or Firm*—Pearne & Gordon LLP

(57) ABSTRACT

A feedback threshold in a hearing device is determined by feeding an input signal to the hearing device while it is inserted in an ear canal of a user. The input signal results in a higher amplification than a supposed, that is, not yet known, feedback threshold. An amplification in the forward path of the device is measured. The feedback threshold is equal to the measured amplification.

6 Claims, 2 Drawing Sheets

METHOD TO DETERMINE A FEEDBACK THRESHOLD IN A HEARING DEVICE

TECHNICAL FIELD

This invention relates to the field of signal processing in hearing devices, and more particularly to a method to determine a feedback threshold in a hearing device.

BACKGROUND OF THE INVENTION

Hearing devices are electronic devices in which sound is recorded by a microphone, is processed or amplified, respectively, in a signal processing unit, and is transmitted into the ear canal of a hearing device user over a loudspeaker which is also called receiver. The amplified or processed sounds which are emitted by the receiver can again be recorded by the microphone, whereby the process is repeated. In other words, it must be dealt with a closed loop comprising a hearing device with an output signal and an input signal. Thereby, the path of the sound energy is not limited to acoustic energy, but also comprises, as the case may be, a mechanical transmission from the output to the input, as e.g. over the housing of the hearing device (so-called body sound). Furthermore, one has realized that over a vent, which is actually used for pressure equalization between the inner ear of the hearing device user and the surrounding, or over electrical paths in the hearing device, signal feedback can occur. It has been shown that of all these possible components, the acoustic signal feedback shows the largest part.

The mentioned effects can result in a squealing for hearing devices, which squealing is very uncomfortable for the hearing device user and finally renders the hearing device unusable during the occurrence of the squealing. Although there exists the possibility to keep the amplification in the hearing device so small that no buildup and therefore no squealing, which is a result of signal feedback, occurs. Therewith, the use of a hearing device is compromised, to be precise in particular for those applications, by which a large hearing loss must be compensated as it occurs for a person who is hard of hearing, because for such patients a comparatively large amplification in the hearing device must be adjusted in order to obtain an adequate compensation of the hearing device.

In order that all amplification settings, in particular the maximum possible amplification setting, for a hearing device can be used in its full extent, it is absolutely necessary to determine the feedback threshold, which means to know the maximum amplification setting in a hearing device for which maximum amplification setting there occurs only just no signal feedback.

Methods to determine the feedback threshold in a hearing device are already known. In U.S. Pat. No. 6,134,329, such a method is described with the aid of which the transfer function of the hearing device is estimated from measurements which are made with a hearing device inserted into the hearing canal of a hearing device user. Thereby, the overall transfer function is calculated with different amplification values without that the closed loop is being opened. Therewith, so-called optimal Weiner filter models are being used. The transfer function in the forward path and the one in the backward path are being calculated together in the following. From the transfer function in the forward path, the possible instable frequencies and the maximum amplification settings can be determined in the hearing device. Furthermore, it is also disclosed how the transfer function in the forward path and the one in the backward path can be calculated from the measurements of the overall transfer function. For these measurements, an additional microphone is inserted into the hearing canal of the hearing device user, the insertion being done into the hearing canal preferably through the vent.

It is obvious that these known methods ask for a large processing power in order to obtain the desired information. Furthermore, an additional microphone is being used for this variant, which is based on an in-situ measurement, by which the acoustical but also the mechanical characteristics of the overall system is being changed in a disadvantageous manner, such that, as a consequence thereof, errors will occur in the further calculations to determine the feedback threshold.

Furthermore, reference is made to U.S. Pat. No. 6,128,392, from which the use of a hearing device with a compensation filter in its feedback path in the form of a FIR-(Finite Impulse Response) filter is known. Acoustical and mechanical signal feedback shall be compensated, an impulse at the output of the hearing device being applied in order to determine the filter coefficients of the compensation filter. At the input of the hearing device, the impulse response is measured and the values for the coefficients are being determined for the compensation filter therefrom. It is an integrated signal feedback damping which has an influence on the overall transfer function of the hearing device partly in an undesirable manner because signal components of the desired signal are being damped at the same time.

For the sake of completeness, reference is made to a method to determine the signal feedback threshold, which method is applied in practice. The method consists therein that the amplification in the hearing device will be increased step by step until signal feedback occurs. As a result, the corresponding value for the amplification, for which only just no signal feedback occurs, corresponds to the signal feedback threshold. This simple method has the great disadvantage that the hearing device user is exposed to high sound levels, namely each time signal feedback occurs. Furthermore, the hearing device must produce a high power during the determination of the feedback threshold.

Therefore, it is an object of the present invention to provide a method which does not incorporate the disadvantages mentioned above.

SUMMARY OF THE INVENTION

The present invention uses the fact that the amplification in the forward path of a compressive system, as it is the case for a hearing device used to compensate a hearing loss, is equal to the damping in the backward path after having reached its steady state in "closed loop" operation. By simply measuring the amplification in the forward path of the hearing device, the feedback threshold can be determined.

It has already been pointed out that knowledge of the feedback threshold is of great importance. This is in particular true if the hearing device disposes over no efficient feedback canceling. But also in the case where a feedback canceling is available, knowledge of the feedback threshold is of great value. Thus, by the present invention, a possibility is given to prove the quality of the hearing device and/or the quality of the hearing piece, in particular for an in-the-ear device (ITE).

Furthermore, the present invention has the following advantages:

The forward path does not have co be cut off to determine the feedback threshold;

at the microphone input of the hearing device, no signal to noise ratio is necessary, i.e. for a given maximum sound pressure P at the ear and for a surrounding noise S, feedback thresholds VEST can be determined by:

$$V_{KRIT}=P-S.$$

The known method uses a signal to noise distance DS at the microphone such that feedback thresholds can be determined up to a value of $$V_{KRIT}=P-(S+DS).$$

For a given surround noise and for the same sound pressure at the ear during the determination of the feedback threshold, a higher amplification can be reached by the present invention;

The method according to the present invention can be realized without or with only little additional expenditure with existing signal processing possibilities which are used in modern hearing devices.

In a further embodiment of the present invention, it is intended to perform the amplification measurement in the forward path in the steady state in different frequency bands, thereby to determine the critical amplification, i.e. the feedback threshold, in each of the frequency bands.

DETAILED DESCRIPTION OF THE INVENTION

Figure 1:
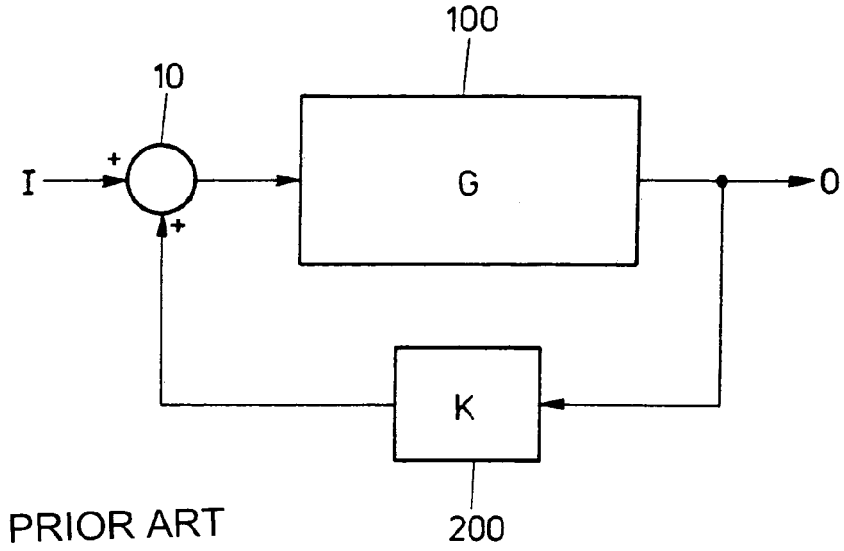
FIG. 1 is a block diagram of a known system having forward and backward paths.

FIG. 1 shows a block diagram for a feedback system as it is generally known. By 100 a processing unit having a transfer function G, and by 200 a feedback unit having a transfer function K are identified. An input signal I is fed to one of the two inputs of an addition unit 10 of which the only output is fed to the processing unit 100. In the processing unit 100, an output signal O is generated that is fed to the second input of the addition unit 10 over the feedback unit 200, besides the circumstance that the output signal O is fed to the outside.

Having identified the transfer function in the forward and in the backward path by G and K, respectively, the following overall transfer function for the system can be obtained as follows according to FIG. 1:

$$\frac{O}{I}=\frac{G}{1-K\cdot G}$$

Figure 2:
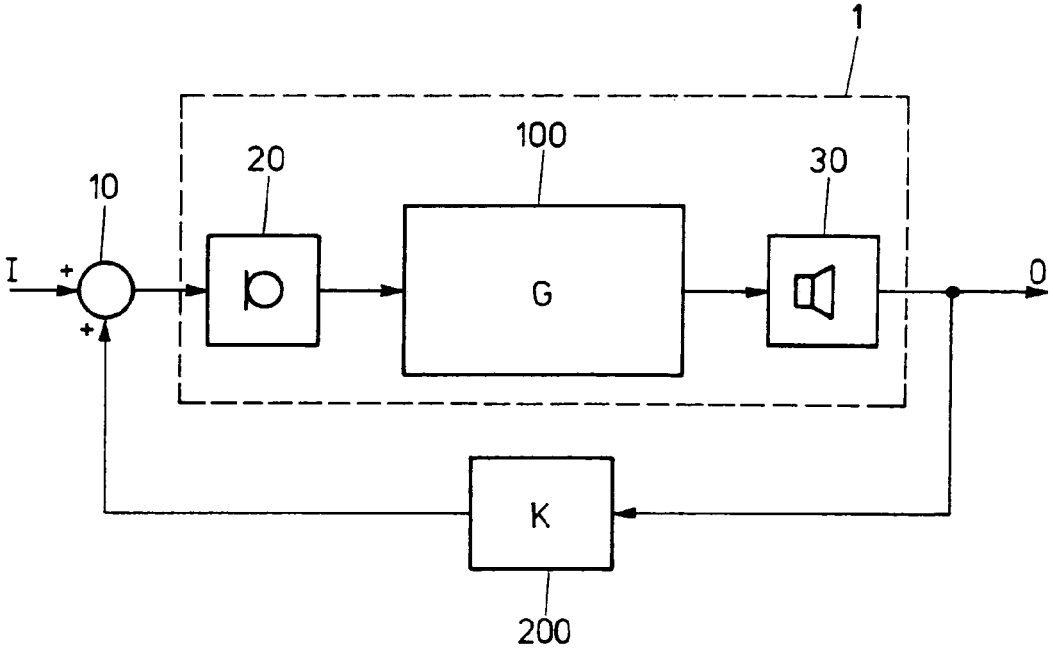
FIG. 2 is a block diagram of a hearing device with a backward path which represents all possible signal feedback for a hearing device.

FIG. 2 shows a block diagram of a hearing device 1, consisting of the processing unit 100 with the transfer function G in imitation of the representation according to FIG. 1. Seen from a propagation direction of signals in the hearing device, a loudspeaker 30, which is also called receiver in the technical field of hearing devices, is positioned after and connected to the processing unit 100, and a microphone 20 is positioned before and connected to the processing unit 100. The output signal of the hearing device 1, respectively of the receiver 30, is again fed over a feedback unit 200, and in addition to an input signal I, to the microphone 20. Correspondingly, an addition unit 10 is provided before the microphone 20, which addition unit 10 has as input signal the input signal I as well as the output signal of the feedback unit 200.

It is emphasized that the simple structure of a hearing device 1 is represented by the processing unit 100. In fact, any other functional unit—as e.g. analogue-to-digital converters, observation units for observation of power supply, digital-to-analogue converters, etc.—can be provided without that the concept of the present invention is overthrown.

The feedback unit 200 with the transfer function K is the actual equivalent circuit for the effects mentioned above, which may result in signal feedback. In this connection, reference is made to the already said and to the general explanations in U.S. Pat. No. 6,134,329.

Apart from additional influences to the overall transfer function on the basis of specific transfer function characteristics of the microphone 20 and the receiver 30, the overall transfer function of the block diagram according to FIG. 2 is equal to the one according to FIG. 1.

Figure 3:
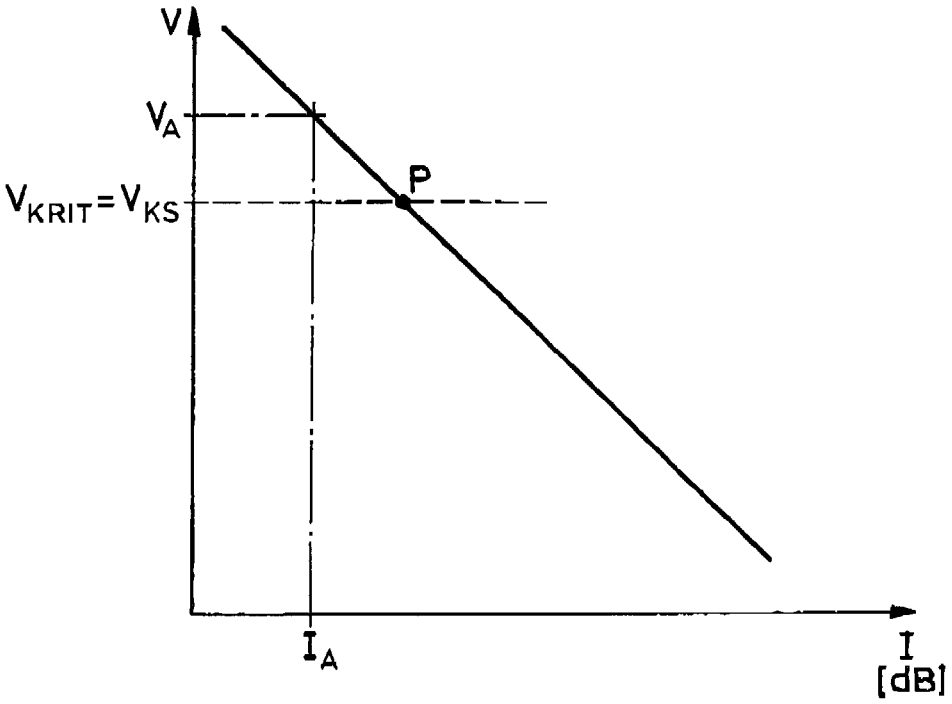
FIG. 3 represents a course of an amplification for which the amplification is drawn in function of an input level of a hearing device in double logarithmic representation.

FIG. 3 shows, in a schematic representation, a course for the amplification of a compressive system, as it is used in a hearing device to compensate a hearing loss. While on the horizontal axis the level of the input signal I is drawn using a logarithmic scale and the unit decibel (dB), on the vertical axis the amplification V is drawn also by using a logarithmic representation. The course of the amplification in function of the input signal level has a negative slope which is one of the characteristics of a compressive system.

In case a compressive system is being used in the forward path, as it can be seen from FIG. 3 for the amplification course in function of the input signal level, and in case the amplification $V_A$ for an input signal $I_A$ is larger than a supposed, i.e. not yet known feedback threshold, the amplification in the forward path will be equal to the damping in the backward path. Therewith, the feedback threshold $V_{KRIT}$ can be determined according to the present invention by measuring the amplification in the forward path because for this measured amplification only just no feedback does occur.

In a further embodiment of the present invention it is provided to fix the slope of the course of amplification V to −1 in a first phase in order to reach the steady state very fast which in turn results in obtaining the feedback threshold $V_{KRIT}$ very quickly. In a later second phase, a flatter slope—which means a slope which is less than −1—is selected for the course of amplification. As a result thereof, a higher exactness for the feedback threshold $V_{KRIT}$ is obtained.

In a further embodiment of the present invention, it is intended to split the range of human hearing into different frequency bands in which each a feedback threshold $V_{KRIT}$ is determined by applying the method mentioned above. Thereby, it is feasible to determine feedback thresholds $V_{KRIT}$ in one or several as well as in all frequency bands. In a preferred embodiment of the present invention, so-called critical frequency bands are used which are given by the structure of the human hearing.

Figure 4:
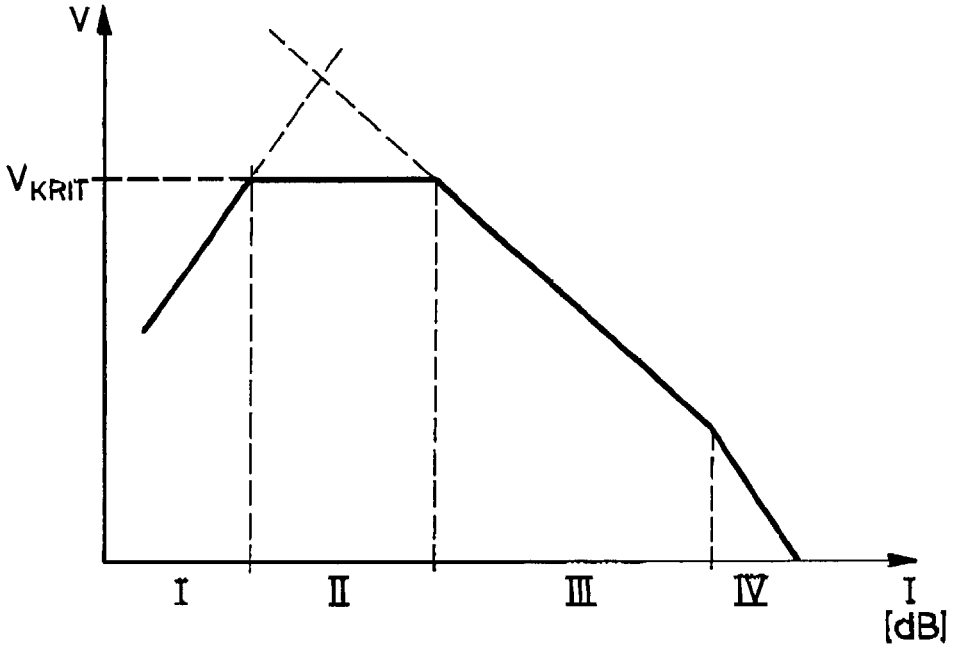
FIG. 4 is a further embodiment for an amplification course as analogously represented in FIG. 3.

By looking at FIG. 4, a further embodiment of the present invention will be described. A course of amplification V is represented of a forward path of a hearing device 1 using the same scaling as in FIG. 3. The course of amplification V corresponds to the one which is adjusted after the determination of the feedback threshold $V_{KRIT}$, whereby four areas I, II, III and IV can be identified. According to the present invention, the amplification course V in the hearing device 1 will be limited with the aid of a limiting unit provided in the hearing device to the maximum amplification $V_{KRIT}$, thereby omitting signal feedback.

What is claimed is:

1. A method to determine a feedback threshold in a hearing device, the method comprising the steps of feeding an input signal to the hearing device inserted to an ear canal of a hearing device user, which input signal results in a higher amplification than the feedback threshold to be determined, measuring an amplification in the forward path of the hearing device, the measured amplification being equal to the feedback threshold, adjusting a course of amplification in function of the level of the input signal in the hearing device as follows: choosing a slope of −1 for a course of amplification represented double-logarithmically in a first phase, and choosing a slope less than −1 for a course of amplification represented double-logarithmically in a second phase.

2. The method according to claim 1, whereby the human hearing range is split into frequency bands, a feedback threshold being determined in at least one of the frequency bands.

3. The method according to claim 2, whereby in each of the frequency bands a feedback threshold is being determined.

4. The method according to claim 1, whereby the amplification in the hearing device is being limited on the basis of the feedback threshold or feedback thresholds, respectively.

5. The method according to claim 2, whereby the amplification in the hearing device is being limited on the basis of the feedback threshold or feedback thresholds, respectively.

6. The method according to claim 3, whereby the amplification in the hearing device is being limited on the basis of the feedback threshold or feedback thresholds, respectively.

* * * * *

UNITED STATES PATENT AND TRADEMARK OFFICE

CERTIFICATE OF CORRECTION

PATENT NO. : 7,010,135 B2
APPLICATION NO. : 10/263126
DATED : March 7, 2006
INVENTOR(S) : Andreas Von Buol It is certified that error appears in the above-identified patent and that said Letters Patent is hereby corrected as shown below:

In column 2, lines 56-57, please delete “particular” and insert --particularly--

In column 2, line 66 , please delete “co” and insert --to--

In column 3, line 4, please delete “VEST” and insert --$V_{KRIT}$ --

In column 10, line 51, please delete “slope—which” and insert --slope – which--

In column 10, line 51, please delete “-1—is” and insert -- -1 – is--

Signed and Sealed this

Sixth Day of March, 2007

JON W. DUDAS
*Director of the United States Patent and Trademark Office*